US012584703B2

(12) United States Patent
Dueck et al.

(10) Patent No.: US 12,584,703 B2
(45) Date of Patent: Mar. 24, 2026

(54) CAM RACE FOR IMPROVED UPPER RECEIVER LONGEVITY

(71) Applicant: SureFire, LLC, Fountain Valley, CA (US)

(72) Inventors: Barry William Dueck, Fountain Valley, CA (US); Henry Mumford, Fountain Valley, CA (US); Michael Standen, Fountain Valley, CA (US); Eric Chow, Fountain Valley, CA (US)

(73) Assignee: SureFire, LLC, Fountain Valley, CA (US)

( * ) Notice: Subject to any disclaimer, the term of this patent is extended or adjusted under 35 U.S.C. 154(b) by 0 days.

(21) Appl. No.: 18/896,697

(22) Filed: Sep. 25, 2024

(65) Prior Publication Data

US 2025/0102251 A1 Mar. 27, 2025

Related U.S. Application Data

(60) Provisional application No. 63/540,900, filed on Sep. 27, 2023.

(51) Int. Cl.
*F41A 3/66* (2006.01)

(52) U.S. Cl.
CPC ..... *F41A 3/66* (2013.01)

(58) Field of Classification Search
None
See application file for complete search history.

(56) References Cited

U.S. PATENT DOCUMENTS

| | | | | |
|---|---|---|---|---|
| 9,068,793 | B1 * | 6/2015 | Barrett | F41A 3/66 |
| 11,768,042 | B2 * | 9/2023 | Geissele | F41A 3/66 42/16 |
| 2023/0008914 | A1 * | 1/2023 | Geissele | F41A 3/66 |

* cited by examiner

*Primary Examiner* — Reginald S Tillman, Jr.
(74) *Attorney, Agent, or Firm* — Rutan & Tucker, LLP; Hani Z. Sayed

(57) ABSTRACT

An apparatus and methods are provided for a cam race for improving the longevity of an upper receiver of a direct gas operated firearm. The cam race provides a hardened slide face and a corner surface for a cam pin comprising a bolt carrier group of the firearm. The cam race is configured to be secured into a window disposed in the upper receiver. The window is surrounded by a counterbored area that receives a back plate of the cam race. The counterbored area and the thickness of the back plate cooperate such that the corner surface and the slide face are positioned to receive the cam pin during reciprocal movement of a bolt carrier group within the upper receiver. The cam race is retained in the upper receiver by fasteners that are tightened into threaded holes in the counterbored area.

9 Claims, 10 Drawing Sheets

FIG. 2
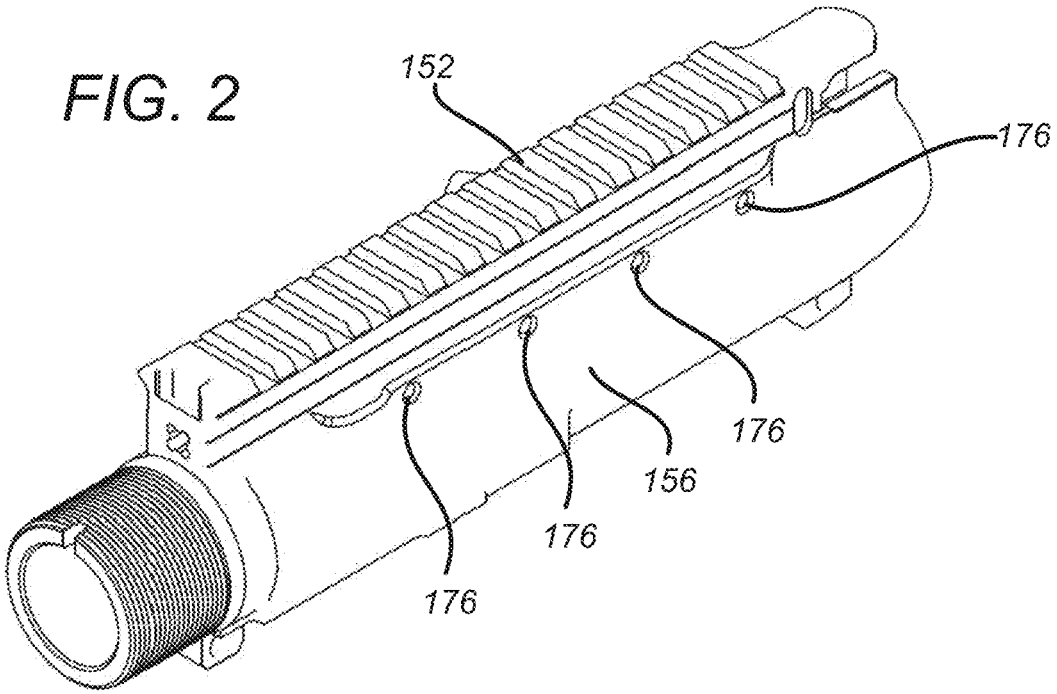
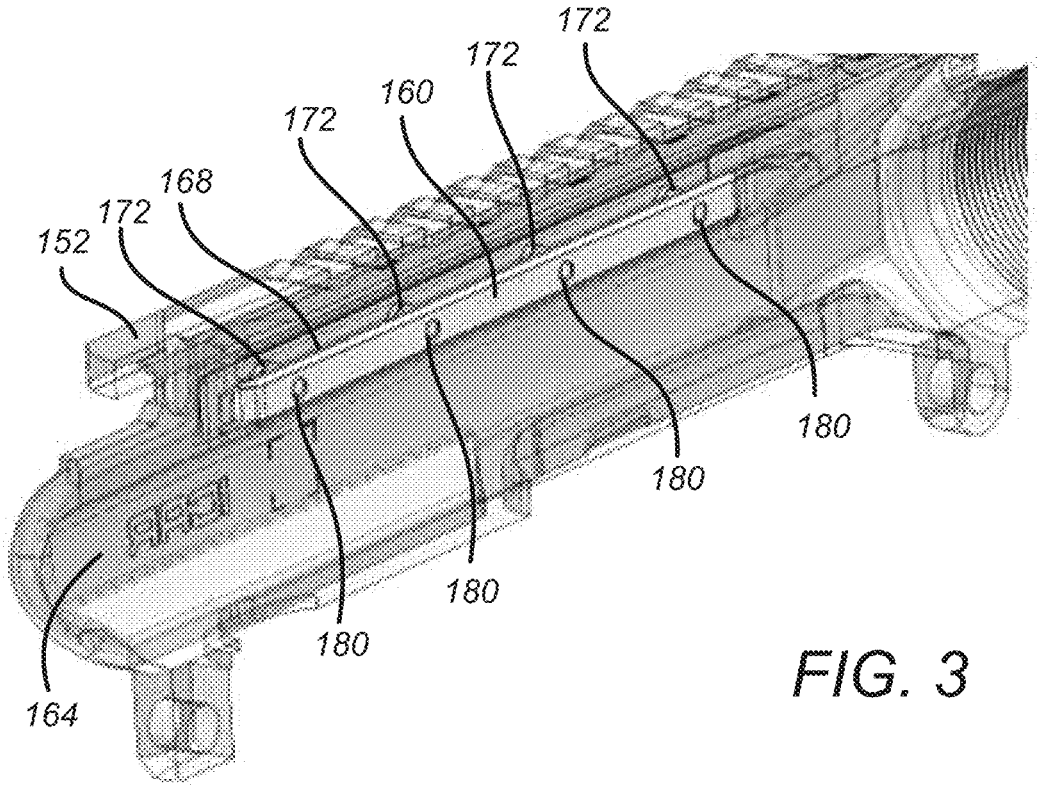
FIG. 3

FIG. 12
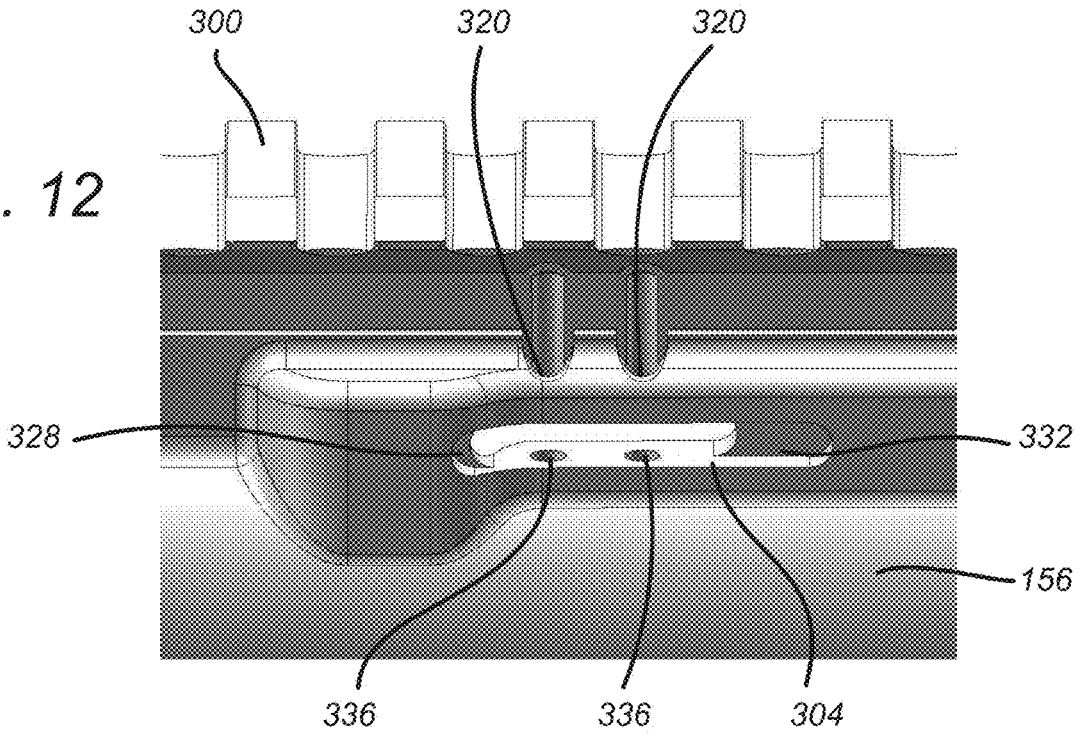
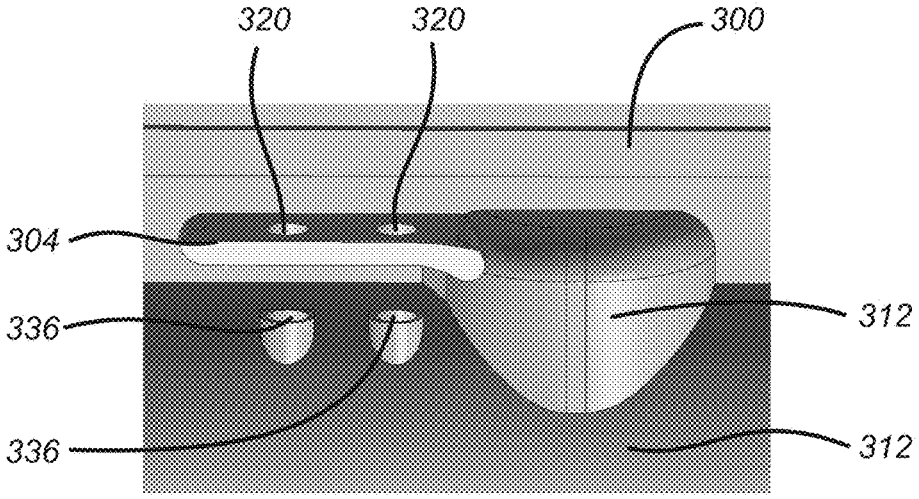
FIG. 13

FIG. 18
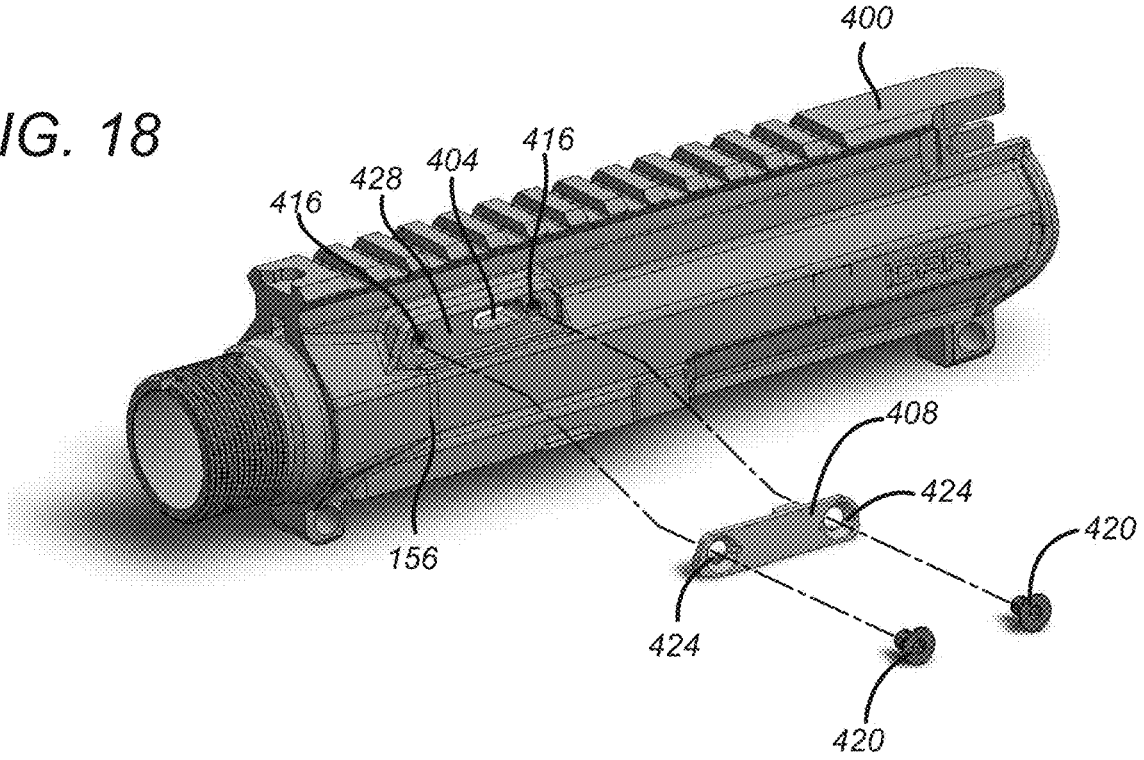
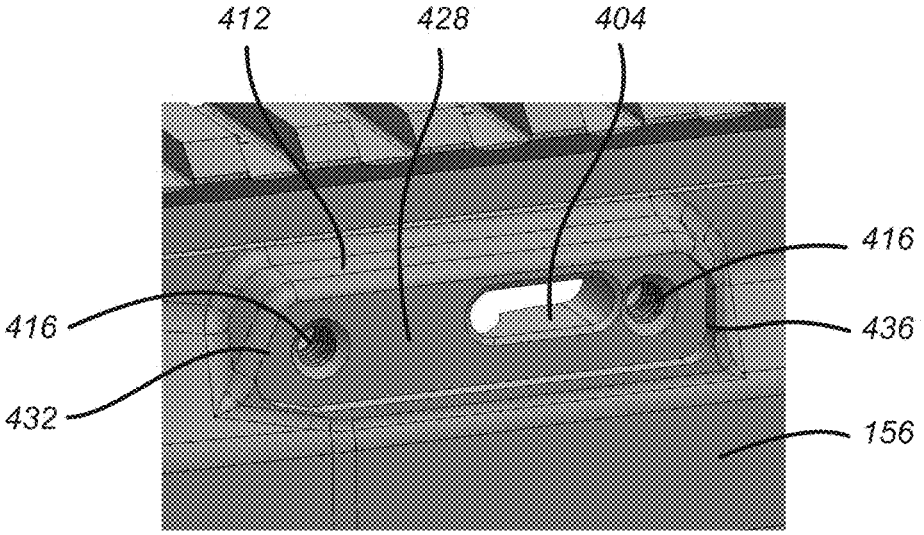
FIG. 19

CAM RACE FOR IMPROVED UPPER RECEIVER LONGEVITY

PRIORITY

This application claims the benefit of and priority to U.S. Provisional Application, entitled "Cam Race For Improved Upper Receiver Longevity," filed on Sep. 27, 2023, and having application Ser. No. 63/540,900, the entirety of said application being incorporated herein by reference.

FIELD

Embodiments of the present disclosure generally relate to firearms. More specifically, embodiments of the disclosure relate to an apparatus and methods for a cam race to provide a reinforced sliding surface for a cam pin to improve longevity of an upper receiver of a direct gas operated firearm.

BACKGROUND

The AR15/M4/M16 family of firearms and their derivatives, including all direct gas operated versions, have been in use by the military and civilian population for many years. An essential component of direct gas operated firearms is the bolt carrier group. Typically, the bolt carrier group includes a bolt mounted in a bolt carrier that is configured for axial sliding movement and rotation within a firearm. The bolt carrier group further includes a cam pin that controls rotation between the bolt and the bolt carrier.

The bolt carrier group generally is configured for stripping or picking up ammunition cartridges from a magazine and moving the cartridges into a battery position within a breech of the firearm. After firing each round, the bolt carrier group extracts and ejects the ammunition cartridge through an ejection port on a side of the firearm. The energy to perform these functions is provided by way of hot, expanding gases from the fired cartridge that are directed through a port closer to the end of the barrel and channeled back to the bolt carrier group. The expanding gases strike, or impinge, the bolt carrier moving it rearward toward the buttstock and into a retracted position. The exhaust gases are then discharged through the ejection port on the side of the firearm. After discharge, a spring acting on the bolt carrier group moves the bolt carrier back to an engaged position while at the same time stripping another cartridge from the magazine and moving that cartridge into the battery position.

A drawback to direct gas operated firearms is that the cam pin comprising the bolt carrier group can wear into and cause gouging of interior surfaces of the upper receiver during the rearward and forward movement of the bolt carrier group. What is needed, therefore, is a reinforced sliding surface that resists wear and gouging by the cam pin and thus provides improved longevity of the upper receiver.

SUMMARY

An apparatus and methods are provided for a cam race for improving the longevity of an upper receiver of a direct gas operated firearm. The cam race provides a hardened slide face and a corner surface for a cam pin comprising a bolt carrier group of the firearm. The cam race is configured to be secured into a window disposed in the upper receiver. The window is surrounded by a counterbored area that is configured to receive a back plate of the cam race. The counterbored area and the thickness of the back plate cooperate such that the corner surface and the slide face are positioned to receive the cam pin during reciprocal movement of a bolt carrier group within the upper receiver. The cam race is retained in the upper receiver by fasteners that are tightened into threaded holes disposed in the counterbored area.

An assembly for improving the longevity of a direct gas operated firearm, the assembly comprising: a cam race configured to be secured into a recess disposed in an upper receiver; a slide face of the cam race for supporting a cam pin in sliding contact; threaded holes positioned along a length of the cam race; and fasteners for engaging the threaded holes to secure the cam to the upper receiver.

In another exemplary embodiment, the cam race comprises a generally elongated member having a thickness that positions the slide face such that the cam pin contacts only the slide face during reciprocal movement of a bolt carrier group comprising the firearm. In another exemplary embodiment, the threaded holes are aligned with holes in the upper receiver. In another exemplary embodiment, the cam race comprises a forward chamfer for guiding the cam pin onto the slide face.

In another exemplary embodiment, four threaded holes are disposed along the length of the cam race. In another exemplary embodiment, the cam race comprises an elongated member having a single threaded hole and a forward tooth. In another exemplary embodiment, the forward tooth is configured to engage with a suitable hole that is machined into the recess.

In another exemplary embodiment, the cam race comprises an elongated backplate having a raised portion. In another exemplary embodiment, the backplate is configured to be fastened into a counterbored portion disposed in a sidewall of the upper receiver such that the raised portion extends through an opening in the sidewall. In another exemplary embodiment, the counterbored portion is disposed on an exterior of the sidewall, such that the backplate is fastened onto an exterior of the upper receiver. In another exemplary embodiment, the counterbored portion is disposed on an interior of the sidewall, such that the backplate is fastened onto the interior of the upper receiver.

An assembly for improving the longevity of a direct gas operated firearm, the assembly comprising: a cam race configured to be secured into a window disposed in an upper receiver; a slide face of the cam race for supporting a cam pin in sliding contact; a corner surface for providing a hardened edge of a cam pocket of the upper receiver; threaded holes positioned near the window; and fasteners for engaging with the threaded holes to secure the cam race in the upper receiver.

In another exemplary embodiment, the upper receiver includes a thickened portion that allows for the depth of the threaded holes. In another exemplary embodiment, the window extends through a sidewall of the upper receiver. In another exemplary embodiment, the window is configured to receive the cam race in the form of an insert that positions the slide face and the corner surface inside the upper receiver to be contacted by the cam pin.

In another exemplary embodiment, the window is surrounded by a counterbored area that has a front end and a rear end that are configured to respectively receive a front edge and a rear edge of the cam race. In another exemplary embodiment, the front edge and the rear edge are configured to engage respectively with the front end and the rear end of the counterbored area. In another exemplary embodiment, the front edge and the rear edge have thicknesses that respectively cooperate with depths of the front end and the rear end of the counterbored area such that the corner surface and the slide face are positioned to receive the cam pin during reciprocal movement of a bolt carrier group within the upper receiver. In another exemplary embodiment, the threaded holes are positioned in the counterbored area and are aligned with countersunk holes of the cam race. In another exemplary embodiment, the cam race is retained in the counterbored area by fasteners being inserted through the countersunk holes and tightened into the threaded holes.

These and other features of the concepts provided herein may be better understood with reference to the drawings, description, and appended claims.

BRIEF DESCRIPTION OF THE DRAWINGS

The drawings refer to embodiments of the present disclosure in which:

FIG. 2 illustrates an isometric view of an exemplary embodiment of an upper receiver that is configured to receive a cam race according to the present disclosure;

FIG. 3 illustrates an isometric cut-away view of an interior of an exemplary embodiment of an upper receiver that includes a cam race in accordance with the present disclosure;

FIG. 12 illustrates a close-up exterior view of an exemplary embodiment of a window disposed in a sidewall of an upper receiver configured to receive a cam race, as shown in FIG. 10;

FIG. 13 illustrates a close-up interior view of an exemplary embodiment of a window disposed in a sidewall of an upper receiver configured to receive a cam race, as shown in FIG. 10;

FIG. 18 illustrates an exploded exterior view of an exemplary embodiment of an upper receiver and a cam race, according to the present disclosure;

FIG. 19 illustrates a close-up view of an exemplary embodiment of a window comprising the upper receiver shown in FIG. 18;

Figure 1:
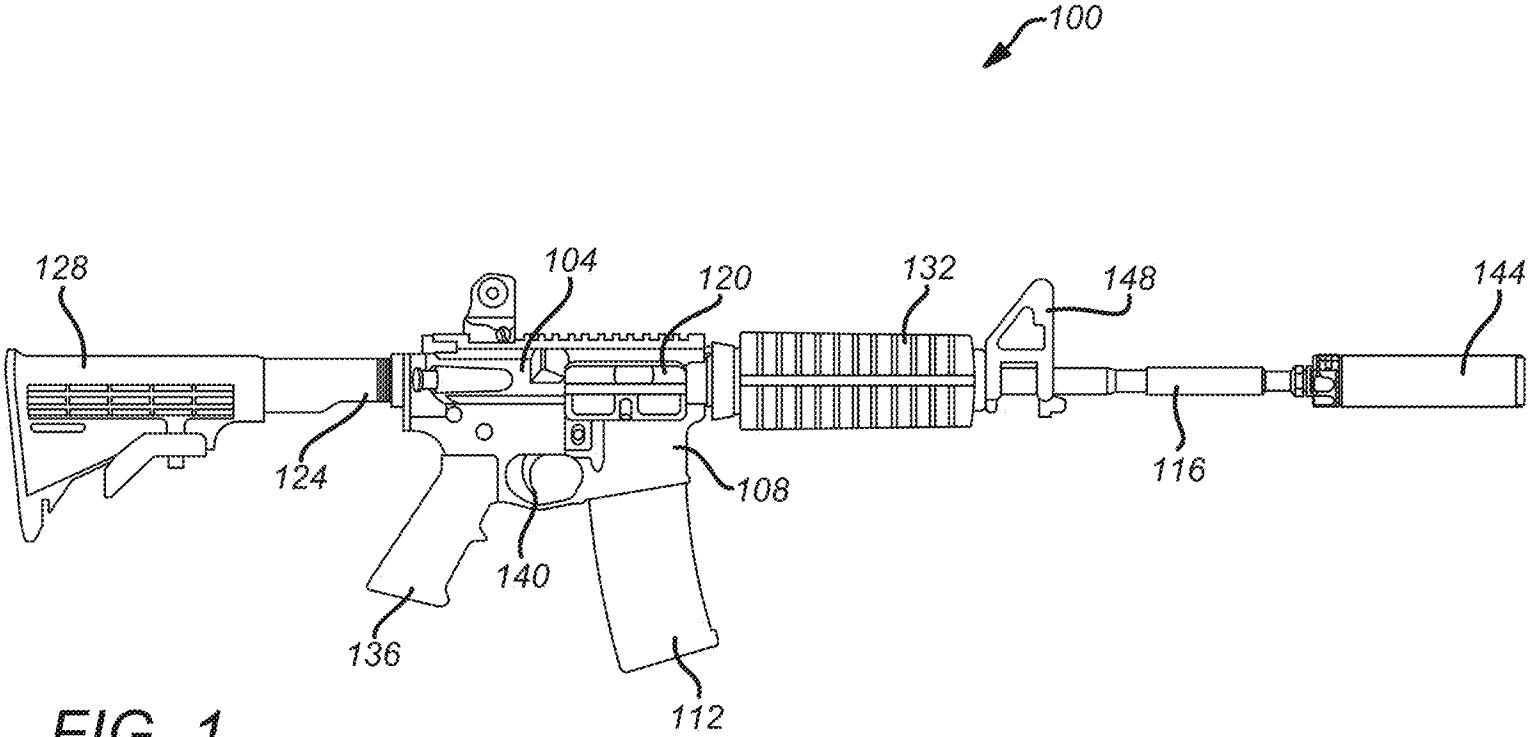
FIG. 1 illustrates a right-side view of an exemplary embodiment of a firearm that utilizes direct gas impingement to operate a bolt carrier group comprising the firearm.

While the present disclosure is subject to various modifications and alternative forms, specific embodiments thereof have been shown by way of example in the drawings and will herein be described in detail. The present disclosure should be understood to not be limited to the particular forms disclosed, but on the contrary, the intention is to cover all modifications, equivalents, and alternatives falling within the spirit and scope of the present disclosure.

DETAILED DESCRIPTION

In the following description, numerous specific details are set forth in order to provide a thorough understanding of the present disclosure. It will be apparent, however, to one of ordinary skill in the art that the cam race and methods disclosed herein may be practiced without these specific details. In other instances, specific numeric references such as "first cam," may be made. However, the specific numeric reference should not be interpreted as a literal sequential order but rather interpreted that the "first cam" is different than a "second cam." Thus, the specific details set forth are merely exemplary. The specific details may be varied from and still be contemplated to be within the spirit and scope of the present disclosure. The term "coupled" is defined as meaning connected either directly to the component or indirectly to the component through another component. Further, as used herein, the terms "about," "approximately," or "substantially" for any numerical values or ranges indicate a suitable dimensional tolerance that allows the part or collection of components to function for its intended purpose as described herein.

The AR15/M4/M16 family of firearms and their derivatives, including all direct gas operated versions, have been in use by the military and civilian population for many years. A drawback to direct gas operated firearms is that the cam pin comprising the bolt carrier group can wear into and cause gouging of interior surfaces of the upper receiver during the rearward and forward movement of the bolt carrier group. Embodiments presented herein provide a cam race that provides a reinforced sliding surface that resists wear and gouging by the cam pin and thus provides improved longevity of the upper receiver.

FIG. 1 illustrates a right-side elevation view of an exemplary embodiment of a firearm 100 that utilizes direct gas impingement to cycle the action of a bolt carrier group comprising the firearm 100. In general, the firearm 100 comprises a member of the AR15/M4/M16 family of firearms, and thus the firearm 100 includes an upper receiver 104 that houses the bolt carrier group (not shown) and a lower receiver 108 that receives a magazine 112 containing a multiplicity of ammunition cartridges. The lower receiver 108 positions the ammunition cartridges within the upper receiver 104 such that the bolt carrier group may strip cartridges into a battery position within a breech of a barrel 116. An ejection port 120 on a side of the upper receiver 104 enables the bolt carrier group to eject spent ammunition cartridges after each round is fired. A buffer tube 124 coupled with a rear of the upper receiver 104 provides a housing for longitudinal movement of the bolt carrier group during stripping and ejecting ammunition cartridges. A buttstock 128, handguards 132, and a grip 136 facilitate a practitioner holding and supporting the firearm 100 during operating the firearm 100 by way of a trigger 140. Further, a suppressor 144 may be coupled with a muzzle end of the barrel 116 to reduce noise and muzzle flash during operating the firearm 100.

As described herein, the bolt carrier group moves longitudinally within the upper receiver 104 during stripping ammunition cartridges from the magazine 112, chambering the cartridges in the breech, and ejecting spent cartridges. The energy to perform these functions is provided by way of hot, expanding gases from each fired cartridge that cause the bolt carrier to move rearward within the buffer tube 124 toward the buttstock 128. The expanding gases are directed to the bolt carrier group from a port distal to the chamber and proximal to an end of the barrel 116 by way of a front sight base 148 and a gas tube (not shown) disposed within the handguards 132. The expanding gases cause the bolt carrier group to move rearward within the buffer tube 124 and then are discharged through the ejection port 120. After discharge, a spring acting on the bolt carrier group moves the bolt carrier forward to an engaged position while at the same time stripping another ammunition cartridge from the magazine 112 and moving that cartridge into the battery position.

FIGS. 2-3 illustrate an exemplary embodiment of an upper receiver 152 that includes a cam race 160 (see FIG. 3) configured to receive a cam pin (not shown) comprising the bolt carrier group, according to the present disclosure. The upper receiver 152 defines an internal, longitudinally disposed cavity, extending in a direction parallel to the length of the firearm 100. The bolt carrier group is slidably positioned within the internal cavity of the upper receiver 152 for axially reciprocating recoil movement therein, as described herein.

An upper portion of the internal cavity is shaped to accommodate the cam pin (not shown) extending upward from the bolt carrier group. As will be appreciated by those skilled in the art, the cam pin maintains a proper rotational position of the bolt during reciprocal movement of the bolt carrier group. In many firearm embodiments, the bolt is biased in a counterclockwise direction, as viewed from the perspective of a user of the firearm 100. The counterclockwise biasing of the bolt presses the cam pin against an interior sidewall 164 (see FIG. 3) of the upper receiver 152. During the reciprocal movement of the bolt carrier group, the cam pin remains in sliding contact with the interior sidewall 164 along a substantially linear cam pin travel path extending between a rearward-most position of the cam pin during the recoil movement of the bolt carrier group and a forwardmost position of the cam pin during a firing action of the bolt.

FIG. 3 illustrates an exemplary embodiment of a cam race 160 installed into an interior of the upper receiver 152, in accordance with the present disclosure. The cam race 160 comprises a generally elongated member that is secured into a groove 168 comprising the interior sidewall 164 of the upper receiver 152. The cam race 160 provides a reinforced surface upon which the cam pin can slide without damaging the interior sidewall 164 of the upper receiver 152. As such, the cam race 160 comprises a hardened material resistant to scoring, etching, scratching, denting, or the formation of other defects within a surface thereof. Given that the material of the upper receiver 152 typically comprises an aluminum material to limit the weight of the firearm 100, the hardened material comprising the cam race 160 provides improved longevity to the upper receiver 152 without contributing to a noticeable increase in weight of the firearm 100.

It is contemplated that any of various hardened materials may be incorporated into the cam race 160, without limitation. In some embodiments, for example, the cam race 160 may comprise a steel material, such as a hardened stainless steel. The hardened steel material may comprise a steel alloy, such as 4340 steel alloy. In some embodiments, the hardened steel material comprising the cam race 160 may be further treated to provide additional durability. In other embodiments, the cam race 160 may comprise titanium, carbon steel, other steel alloys, and/or other materials that are highly resistant to wear. In some embodiments, at least a portion of the cam race 160 may be heat treated. In some embodiments, at least a portion of the cam race 160 may be polished and/or has a nitride finish to provide desired frictional properties that facilitate sliding of the cam pin along the cam race 160. It is contemplated that other finishing techniques, surface treatments, and the like may be incorporated into the cam race 160, without limitation, to provide desired surface properties of the cam race 160.

Figure 4:
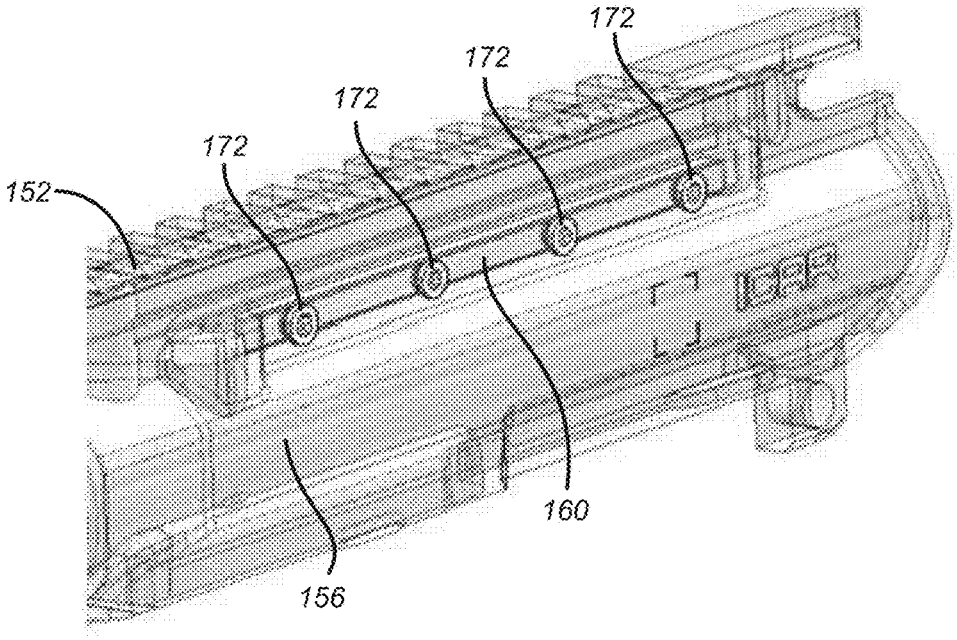
FIG. 4 is an exterior isometric ghost-view of the upper receiver of FIG. 3 that illustrates screws fixating the cam race within the upper receiver in accordance with the present disclosure.

As shown in FIGS. 3-4, the cam race 160 is secured into the groove 168 by way of multiple fasteners 172. Each of the fasteners 172 is inserted through a hole 176 (see FIG. 2) disposed in the sidewall 156 of the upper receiver 152 and threaded into threaded holes 180 disposed in the cam race 160. Any number of fasteners 172 and holes 176, 180 may be used to secure the cam race 160, without limitation. In the illustrated embodiment, however, four fasteners 172 and holes 176, 180 are used to secure the cam race 160 into the upper receiver 152. Further, it is contemplated that the cam race 160 has a thickness and the groove 168 has a depth that are cooperatively sized to position a slide face of the cam race 160 such that the cam pin contacts only the slide face during the reciprocal movement of the bolt carrier group.

Figure 5:
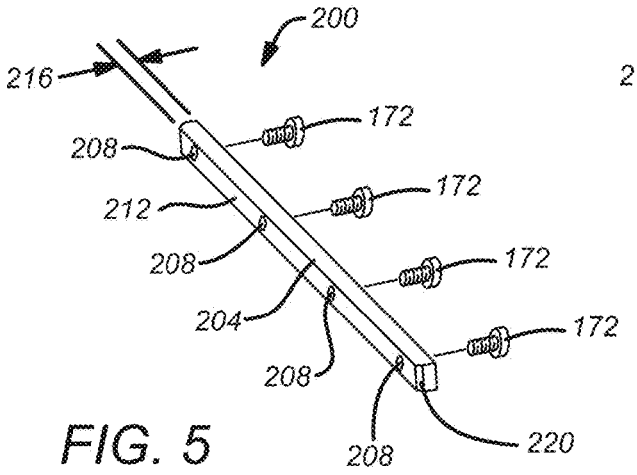
FIG. 5 illustrates an isometric exploded view of an exemplary embodiment of a cam race and associated fasteners configured to improve the longevity of an upper receiver of a direct gas operated firearm.

FIG. 5 illustrates an exemplary embodiment of a cam race 200 that is configured to improve the longevity of an upper receiver 152 of a direct gas operated firearm 100. The cam race 200 comprises a generally elongated member 204 configured to be secured into a recess, such as the groove 168 shown in FIG. 3. Threaded holes 208 are positioned along the length of the elongated member 204 to receive fasteners 172. As discussed hereinabove, each of the fasteners 172 may be inserted through a hole 176 (see FIG. 2) in the sidewall 156 of the upper receiver 152 and engaged with a threaded hole 208. As will be appreciated, tightening the fasteners 172 secures the cam race 200 into the groove 168. It is contemplated that the elongated member 204 has a thickness 216 that positions a slide face 212 of the cam race 200 such that the cam pin contacts only the slide face 212 during the reciprocal movement of the bolt carrier group. Further, the elongated member 204 may comprise a forward chamfer 220 that provides an angled surface for guiding the cam pin onto the slide face 212. It is envisioned that the forward chamfer 220 generally reduces impact wear on the cam pin that would occur due to an otherwise sharp edge.

Figure 6:
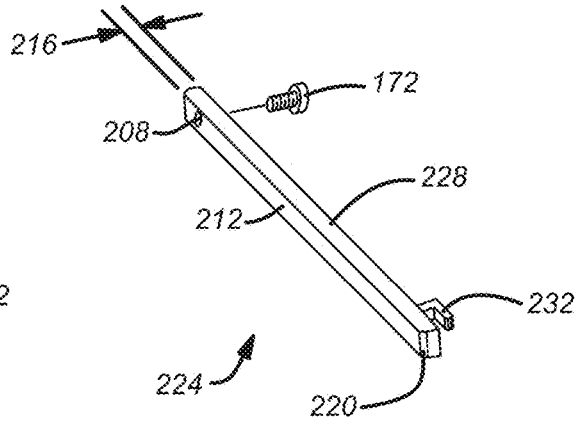
FIG. 6 illustrates an isometric exploded view of an exemplary embodiment of a cam race having a tooth and a single fastener for improving the longevity of an upper receiver of a direct gas operated firearm.

FIG. 6 illustrates an exemplary embodiment of a cam race 224 that is configured to improve the longevity of an upper receiver 152 of a direct gas operated firearm 100. The cam race 224 is substantially similar to the cam race 200, shown in FIG. 5, with the exception that the cam race 224 comprises an elongated member 228 having a single threaded hole 208 and a forward tooth 232, in lieu of the multiple threaded holes 208, as shown in FIG. 5. The forward tooth 232 may be configured to engage with a suitable hole (not shown) that is machined into the groove 168 disposed in the interior sidewall 164 of the upper receiver 152. The threaded hole 208 is configured to receive a fastener 172 that fixates the elongated member 228 within a recess, such as the groove 168 of FIG. 3. Further, the elongated member 228 has a thickness 216 that positions a slide face 212 of the cam race 224 to receive the cam pin, such that the cam pin contacts only the slide face 212 during the reciprocal movement of the bolt carrier group. Further, the elongated member 228 comprises a forward chamfer 220 that provides an angled surface for reducing impact wear on the cam pin as it slides onto the slide face 212.

Figure 7:
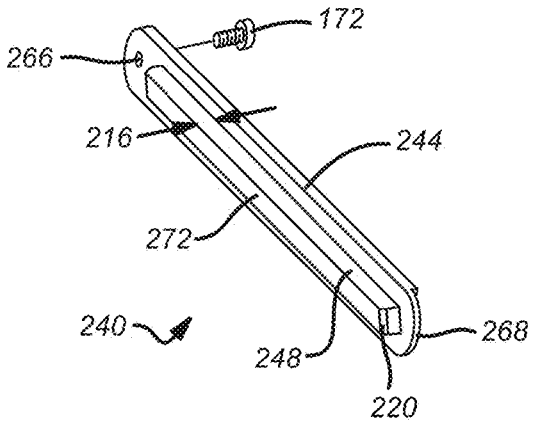
FIG. 7 illustrates an isometric exploded view of an exemplary embodiment of a cam race having a backplate, a ledge, and a single fastener that may be implemented for improving the longevity of an upper receiver of a direct gas operated firearm.
Figure 9:
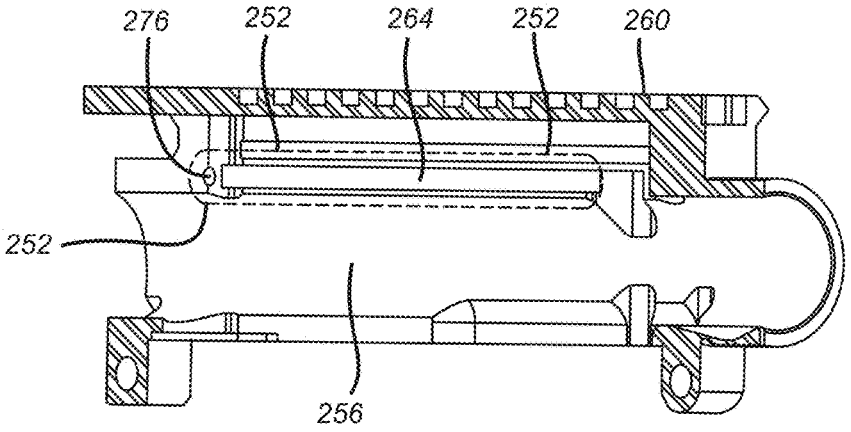
FIG. 9 illustrates an isometric cross-sectional view taken along a midline of an upper receiver having a window configured to receive the cam race of FIG. 7, according to the present disclosure.

FIG. 7 illustrates an exemplary embodiment of a cam race 240 that is configured to improve the longevity of an upper receiver 260 (see FIG. 9) of a direct gas operated firearm 100. The cam race 240 comprises an elongated backplate 244 having a raised portion 248. The backplate 244 is configured to be fastened into a counterbored portion 252 disposed in a sidewall 256 of the upper receiver 260 such that the raised portion 248 extends through an opening 264 in the sidewall 256. In some embodiments, the counterbored portion 252 may be disposed on an exterior of the sidewall 256, such that the backplate 244 may be fastened onto the exterior of the upper receiver 260. In some embodiments, however, the counterbored portion 252 may be disposed on an interior of the sidewall 256, such that the backplate 244 may be fastened onto the interior of the upper receiver 260.

In the illustrated embodiment of FIG. 7, the cam race 240 includes a single hole 266 and a forward ledge 268. The forward ledge 268 may be configured to engage with a suitable ledge (not shown) that is machined into the sidewall 256 of the upper receiver 260. The hole 266 is configured to receive a fastener 172 that may be engaged with a threaded hole 276 in the upper receiver 260 (see FIG. 9) to fixate the backplate 244 within the counterbored portion 252. It is contemplated that the counterbored portion 252 has a depth such that the raised portion 248 extends through the opening 264 shown in FIG. 9. As will be appreciated, the raised portion 248 has a thickness 216 that positions a slide face 272 of the cam race 240 to receive the cam pin, such that the cam pin contacts only the slide face 272 during the reciprocal movement of the bolt carrier group. The raised portion 248 further includes a forward chamfer 220 that provides an angled surface for guiding the cam pin onto the slide face 272.

Figure 8:
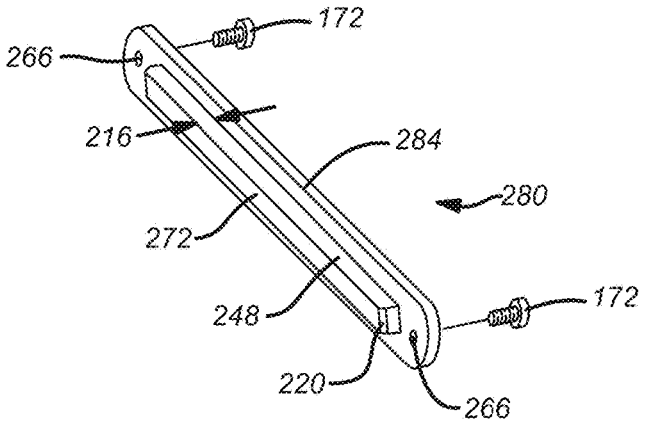
FIG. 8 illustrates an isometric exploded view of an exemplary embodiment of a cam race having a backplate and associated fasteners that may be implemented for improving the longevity of an upper receiver of a direct gas operated firearm in accordance with the present disclosure.

FIG. 8 illustrates an exemplary embodiment of a cam race 280 that is configured to improve the longevity of the upper receiver 260 (see FIG. 9) of a direct gas operated firearm 100. The cam race 280 is substantially similar to the cam race 240, shown in FIG. 7, with the exception that the cam race 280 includes a forward hole 266, in lieu of the forward ledge 268 comprising the cam race 240. The cam race 280 of FIG. 8 comprises an elongated backplate 284 having a raised portion 248. The backplate 284 is configured to be fastened into the counterbored portion 252 disposed in a sidewall 256 of the upper receiver 260 such that the raised portion 248 extends through the opening 264 in the sidewall 256.

As shown in FIG. 8, the cam race 280 includes a rearward hole 266 and the forward hole 266. Each of the holes 266 is configured to receive a fastener 172 that may be engaged with a threaded hole 276 in the upper receiver 260 (see FIG. 9) to fixate the backplate 284 within the counterbored portion 252. As mentioned above, the counterbored portion 252 has a depth that extends the raised portion 248 through the opening 264 shown in FIG. 9. Further, the raised portion 248 has a thickness 216 that positions a slide face 272 of the cam race 280 to receive the cam pin, such that the cam pin contacts only the slide face 272 during the reciprocal movement of the bolt carrier group. The raised portion 248 further includes a forward chamfer 220 that provides an angled surface for guiding the cam pin onto the slide face 272.

In some embodiments, the counterbored portion 252 may be disposed on an exterior of the sidewall 256, such that the backplate 284 may be fastened onto the exterior of the upper receiver 260. In some embodiments, however, the counterbored portion 252 may be disposed on an interior of the sidewall 256, such that the backplate 284 may be fastened onto the interior of the upper receiver 260. It is contemplated that, in some embodiments, disposing the counterbored portion 252 on the interior of the sidewall 256 obviates the opening 264 in the upper receiver 260.

It should be borne in mind that the cam race is not limited to the specific embodiments illustrated and discussed hereinabove. For example, in some embodiments, the cam race may include a mounting rail, in lieu of the threaded holes 208 of FIG. 5. In such embodiments, the mounting rail may be engaged in a friction fit within a recess that is machined into the upper receiver. Further, in some embodiments, the backplate 284, shown in FIG. 8, may be spot welded into the counterbored portion 252 shown in FIG. 9, thereby obviating the fasteners 172, the holes 266, and the forward ledge 268. Further, in some embodiments, the cam race 280 of FIG. 8 may be adjustable, thereby enabling a user of the firearm 100 to tune the position of the raised portion 248 within the upper receiver 260.

Figure 10:
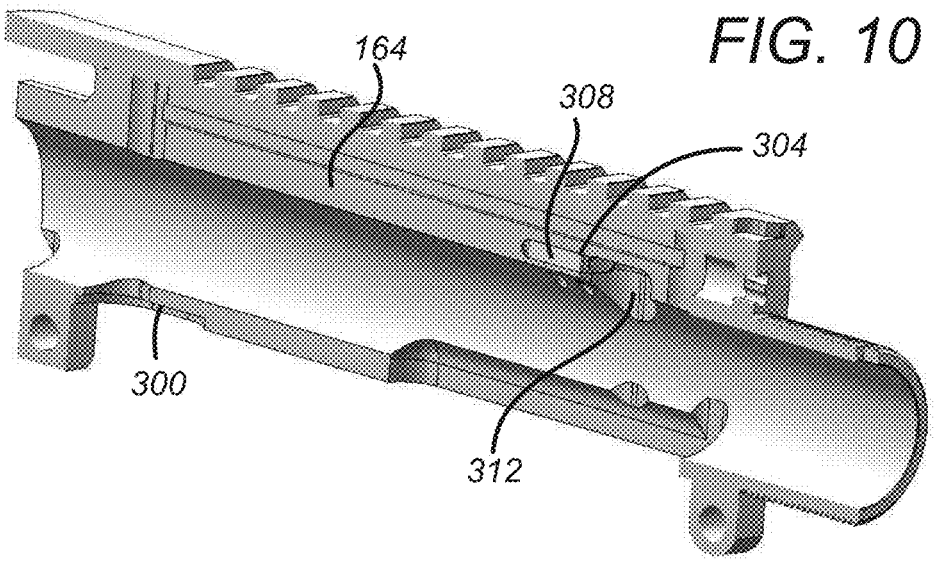
FIG. 10 illustrates an isometric cross-sectional view taken along a midline of an exemplary embodiment of an upper receiver having a window configured to receive an exemplary embodiment of a cam race, according to the present disclosure.

FIG. 10 illustrates a cross-sectional view of an exemplary embodiment of an upper receiver 300 having a window 304 that receives a cam race 308, according to the present disclosure. The upper receiver 300 is substantially similar to the upper receiver 260, shown in FIG. 9, with the exception that the upper receiver 300 includes a window 304 that is shorter than the window 264 comprising the upper receiver 260. Accordingly, the cam race 308 shown in FIG. 10 is shorter than the cam races 240, 280 that are configured to fit into the window 264.

In general, the cam race 308 is configured to provide a reinforced edge of a cam pocket 312 comprising the upper receiver 300. Further, the cam race 308 provides a reinforced surface upon which the cam pin can slide without damaging the interior sidewall 164 of the upper receiver 300. As such, the cam race 308 comprises a hardened material resistant to scoring, etching, scratching, denting, or the formation of other defects within a surface thereof. Given that the material of the upper receiver 300 typically comprises an aluminum material to limit the weight of the firearm 100, the hardened material comprising the cam race 308 provides improved longevity to the upper receiver 300 without contributing to a noticeable increase in weight of the firearm 100.

Figure 11:
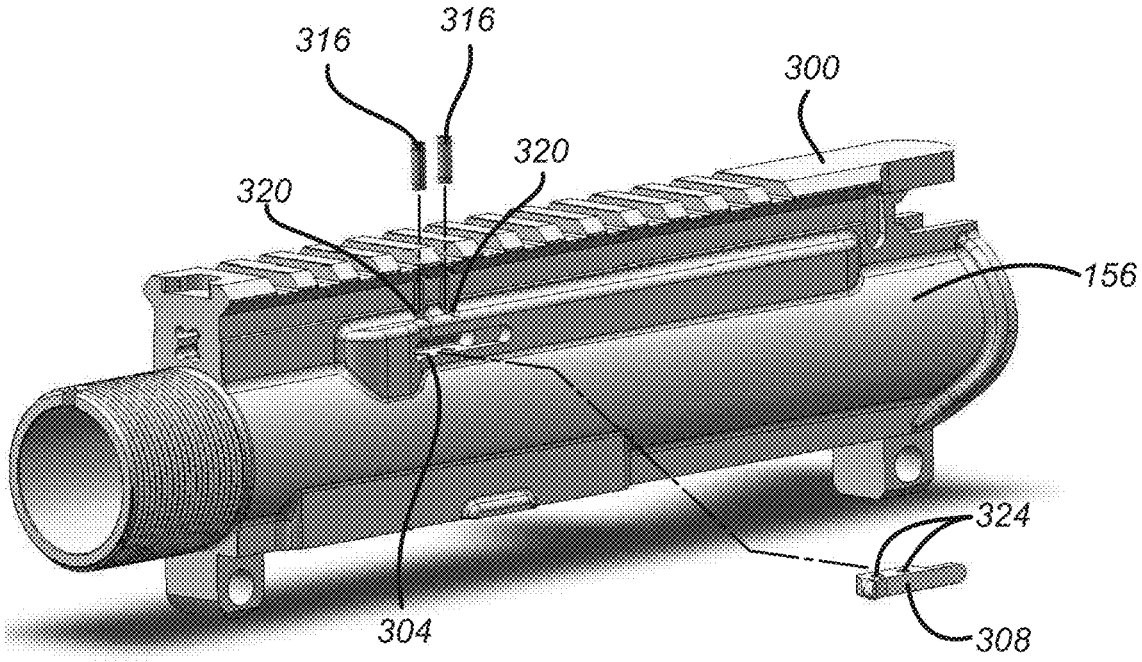
FIG. 11 illustrates an exploded exterior view of the upper receiver and cam race shown in FIG. 10.

FIG. 11 illustrates an exploded exterior view of the upper receiver 300 and the cam race 308 shown in FIG. 10. As shown in FIG. 11, the window 304 extends through a sidewall 156 of the upper receiver 300. The window 304 is configured to receive the cam race 308 in the form of an insert that positions a slide face of the cam race 308 as shown in FIG. 10. The cam race 308 may be retained in the window 304 by inserting slotted spring pins 316 into vertical holes 320 in the upper receiver 300 such that the pins 316 extend through holes 324 in the cam race 308, as described herein.

FIGS. 12-13 illustrate close-up views of the window 304 shown in FIG. 10. The window 304 is of a counterbored variety of window having a front counterbore 328 and a rear counterbore 332. The front and rear counterbores 323, 332 are configured to support the cam race 308 such that a slide face of the cam race 308 is positioned as shown in FIG. 10. As shown in FIGS. 12-13, the upper receiver 300 includes upper holes 320 that are vertically aligned with lower holes 336. The upper and lower holes 320, 336 are positioned with respect to the window 304 such that the cam race 308 may be retained in the upper receiver by inserting slotted spring pins 316 into the upper holes 320, through holes 324 (see FIGS. 14-15) in the cam race 308, and into the lower holes 336.

Figure 14:
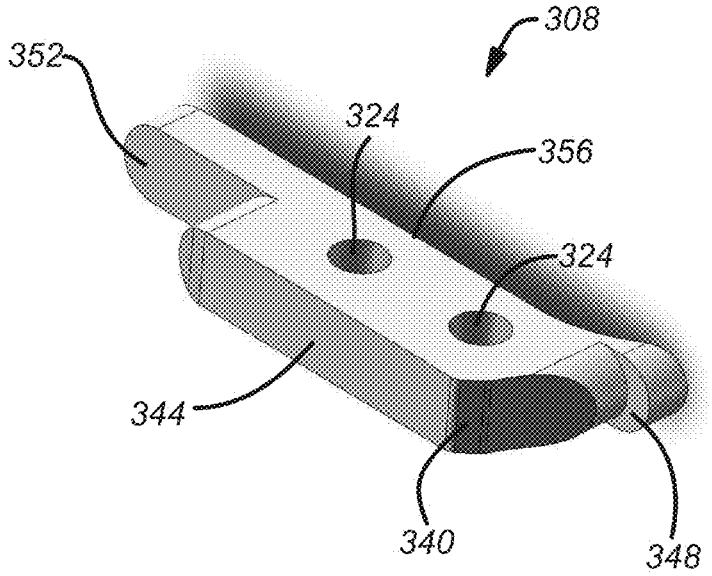
FIG. 14 illustrates a first isometric view of an exemplary embodiment of a cam race that may be incorporated into the upper receiver of FIG. 10, according to the present disclosure.
Figure 15:
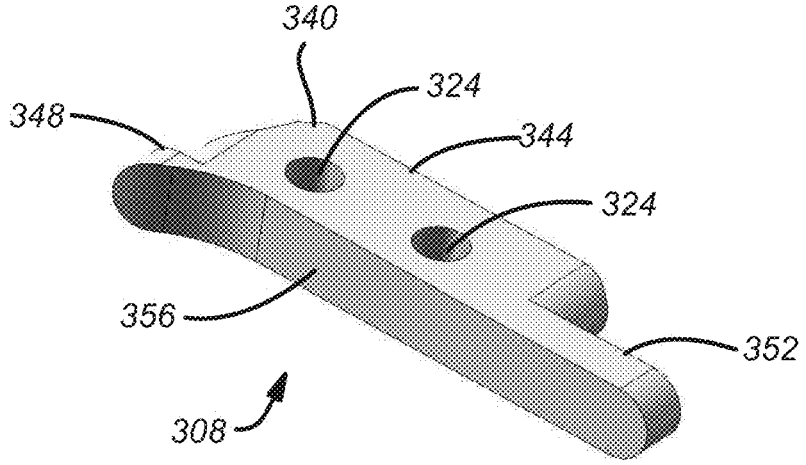
FIG. 15 illustrates a second isometric view of the cam race of FIG. 14, according to the present disclosure.

FIGS. 14-15 illustrate isometric views of an exemplary embodiment of a cam race 308 that may be incorporated into the upper receiver 300 shown in FIG. 10, according to the present disclosure. As best shown in FIG. 14, the cam race 308 is a generally elongate member having a corner surface 340 and a slide face 344. The cam race 308 is configured to be fastened into a window 304 disposed in the sidewall 156 of the upper receiver 300 such that the corner surface 340 and the slide face 344 comprise reinforced portions of the interior surface 164 of the upper receiver 300, as shown in FIG. 10. More specifically, the slide face 344 preferably provides a hardened portion of the interior sidewall 164 upon which the cam pin slides during the reciprocating motion of the bolt carrier group during a firing action of the bolt. Further, the corner surface 340 serves as a hardened edge of the cam pocket 312 that is capable of withstanding impacts by the cam pin during the reciprocating motion of the bolt carrier group.

In the illustrated embodiment, the cam race 308 includes a front ledge 348 and a rear ledge 352. The front and rear ledges 348, 352 are configured to engage with suitable ledges that are machined into the sidewall 156 of the upper receiver 300, such as the respective front and rear counterbores 328, 332 shown in FIG. 12. It is contemplated that the front and rear ledges 348, 352 have thicknesses that respectively cooperate with depths of the front and rear counterbores 328, 332 such that the corner surface 340 and the slide face 344 are positioned to receive the cam pin during the reciprocal movement of the bolt carrier group. Further, the thicknesses of the front and rear ledges 348, 352 and the depths of the front and rear counterbores 328, 332 are such that an exterior surface 356 of the cam race 308 aligns smoothly with the exterior surface of the sidewall 156 of the upper receiver 300.

Figure 16:
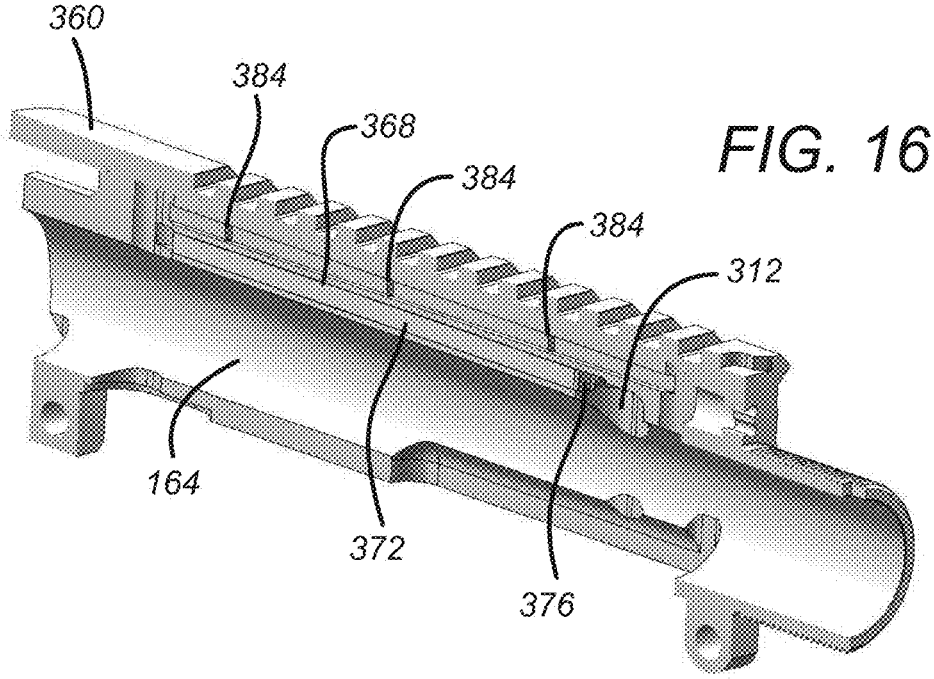
FIG. 16 illustrates an isometric cross-sectional view taken along a midline of an exemplary embodiment of an upper receiver having a groove configured to receive an exemplary embodiment of a full-length cam race, according to the present disclosure.
Figure 17:
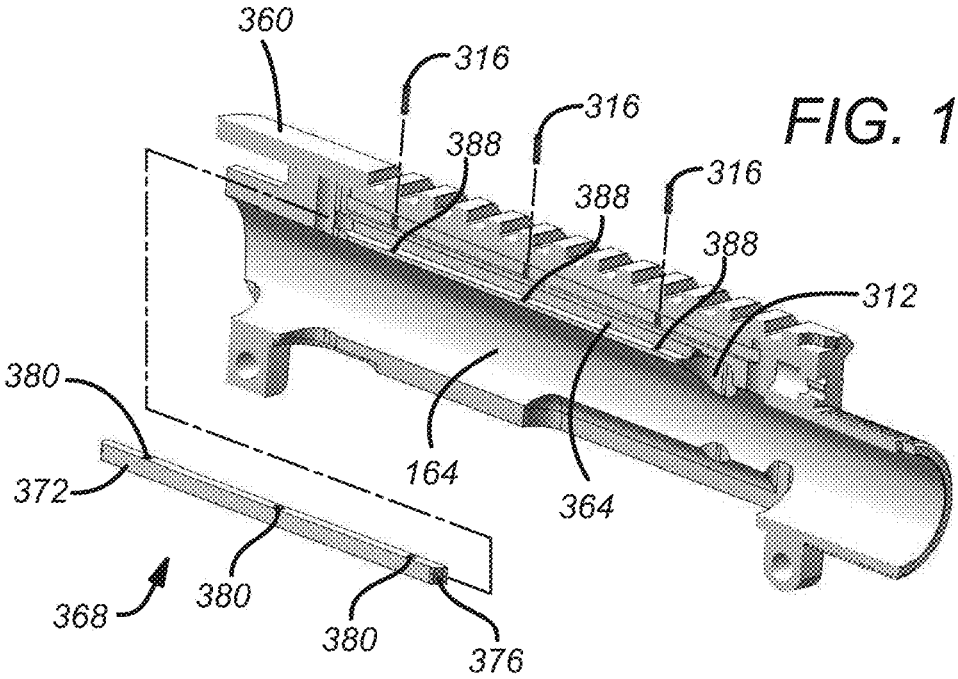
FIG. 17 illustrates an exploded view of the upper receiver and cam race of FIG. 16, according to the present disclosure.

FIGS. 16-17 illustrate cross-sectional views of an exemplary embodiment of an upper receiver 360 having a recess 364 configured to receive a full-length cam race 368, according to the present disclosure. The full-length cam race 368 is configured to provide a hardened slide face 372 to receive sliding contact of the cam pin throughout the reciprocal movement of the bolt carrier group. As such, the cam pin remains in sliding contact with the cam race 368 along a substantially linear cam pin travel path extending between a rearward-most position of the cam pin during the recoil movement of the bolt carrier group and a forwardmost position of the cam pin during a firing action of the bolt. Further, the cam race 368 includes a corner surface 376 that serves as a hardened edge of the cam pocket 312 that is capable of withstanding impacts by the cam pin during the reciprocating motion of the bolt carrier group.

As best shown in FIG. 17, the cam race 368 includes multiple vertical holes 380 disposed along the length of the cam race 368. The vertical holes 380 are configured to align between upper holes 384 and lower holes 388 disposed in the upper receiver 360 adjacent to the recess 364. As will be appreciated, the holes 380, 384, 388 are configured to receive slotted spring pins 316 whereby the cam race 368 may be fastened into the recess 364. In the illustrated embodiment, the cam race 368 includes three vertical holes 380 disposed substantially uniformly along the length of the cam race 368. It is contemplated, however, that in other embodiments, any number of vertical holes 380 may be incorporated into the cam race 368, without limitation.

It should be understood that the cam race 368 is not limited to the specific embodiment illustrated and discussed with respect to FIGS. 16-17. For example, in some embodiments, the cam race 368 may be retained in the recess 364 by way of screws, or other suitable fasteners, in lieu of the slotted spring pins 316, without limitation. Further, in some embodiments, the cam race 368 may be spot welded into the recess 364, thereby obviating the slotted spring pins 316 and the holes 380, 384, 388.

FIG. 18 illustrates an exploded view of an exemplary embodiment of an upper receiver 400 having a window 404 that receives a cam race 408, according to the present disclosure. The upper receiver 400 is substantially similar to the upper receiver 300, shown in FIGS. 10-11, with the exception that the upper receiver 400 includes a thickened portion 412 and threaded holes 416 in lieu of the upper and lower holes 320, 336 shown in FIGS. 12-13. As shown in FIG. 19, the thickened portion 412 comprises a portion of the sidewall 156 of the upper receiver 400 that allows for the depth of the threaded holes 416.

As described herein, the cam race 408 generally is configured to provide a reinforced edge of a cam pocket 312 (see FIG. 13) comprising the upper receiver 400. Further, the cam race 408 provides a reinforced surface upon which the cam pin can slide without damaging the interior sidewall 164 (see FIG. 10) of the upper receiver 400. As such, the cam race 408 comprises a hardened material resistant to scoring, etching, scratching, denting, or the formation of other defects within a surface thereof. Given that the material of the upper receiver 400 typically comprises an aluminum material to limit the weight of the firearm 100, the hardened material comprising the cam race 408 provides improved longevity to the upper receiver 400 without contributing to a noticeable increase in weight of the firearm 100.

As shown in FIGS. 18-19, the window 404 extends through the sidewall 156 of the upper receiver 400. The window 404 is configured to receive the cam race 408 in the form of an insert that positions a slide face of the cam race 408 as shown in FIG. 10 in connection with the cam race 308. The cam race 408 may be retained in the window 404 by inserting fasteners 420 through countersunk holes 424 of the cam race 408 and then tightening the fasteners 420 into the threaded holes 416 of the upper receiver 400 such that the cam race 408 is disposed in a counterbored area 428 as described herein.

FIG. 19 illustrates a close-up view of the window 404 shown in FIG. 18. The window 404 is surrounded by a counterbored area 428 that has a front end 432 and a rear end 436. The front and rear ends 432, 436 are configured to respectively receive front and rear edges 400, 444 (see FIG. 21) of the cam race 408 such that the cam race 408 cannot be improperly installed into the window 404. As shown in FIG. 19, the upper receiver 400 includes threaded holes 416 that are aligned with countersunk holes 424 of the cam race 408. The threaded holes 416 are positioned with respect to the window 404 such that the cam race 408 may be retained in the counterbored area 428 by inserting fasteners 420 through the countersunk holes 424 and tightening the fasteners into the threaded holes 416 of the upper receiver 400.

Figure 20:
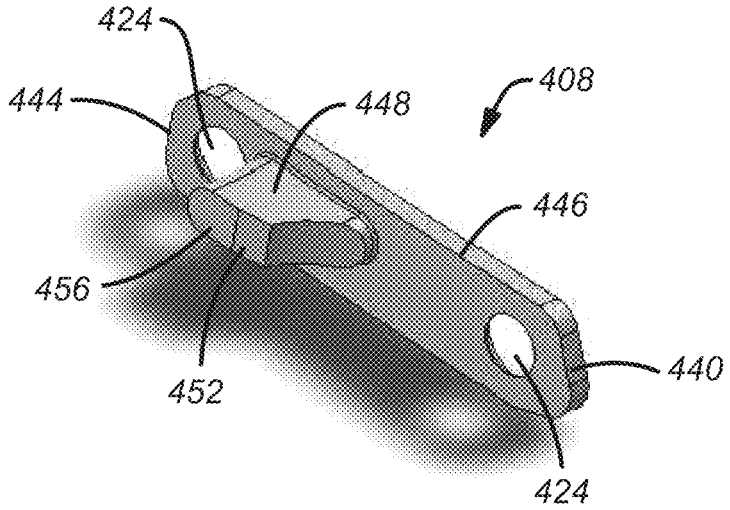
FIG. 20 illustrates a first isometric view of an exemplary embodiment of a cam race that may be incorporated into the upper receiver of FIG. 18, according to the present disclosure.
Figure 21:
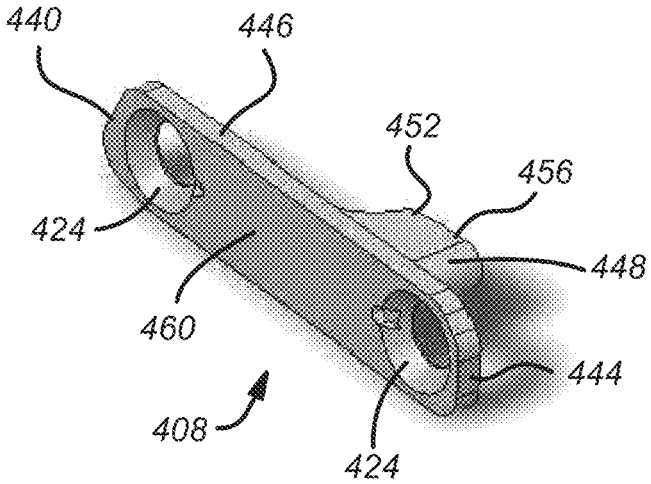
FIG. 21 illustrates a second isometric view of the cam race of FIG. 20, according to the present disclosure.

FIGS. 20-21 illustrate isometric views of an exemplary embodiment of a cam race 408 that may be incorporated into the upper receiver 400 shown in FIG. 18, according to the present disclosure. The cam race 408 comprises a backplate 446 having a side protrusion 448 that terminates with a corner surface 452 and a slide face 456. The cam race 408 is configured to be fastened into a window 404 disposed in the sidewall 156 of the upper receiver 400 such that the corner surface 452 and the slide face 456 comprise reinforced portions of the interior surface 164 (see FIG. 10) of the upper receiver 400, as described above. More specifically, the slide face 456 preferably provides a hardened portion of the interior sidewall 164 upon which the cam pin slides during the reciprocating motion of the bolt carrier group during a firing action of the bolt. Further, the corner surface 452 serves as a hardened edge of the cam pocket 312 (see FIG. 13) that is capable of withstanding impacts by the cam pin during the reciprocating motion of the bolt carrier group.

In the illustrated embodiment, the cam race 408 includes a front edge 440 and a rear edge 444. The front and rear edges 440, 444 are configured to engage respectively with the front and rear ends 432, 436 of the counterbored area 428 shown in FIG. 19. It is contemplated that the front and rear edges 440, 444 have thicknesses that respectively cooperate with depths of the front and rear ends 432, 436 of the counterbored area 428 such that the corner surface 452 and the slide face 456 are positioned to receive the cam pin during the reciprocal movement of the bolt carrier group.

As best shown in FIG. 21, countersunk holes 424 are disposed in the back plate 446 near each of the front and rear edges 440, 444. The countersunk holes 424 are positioned to align with threaded holes 416 disposed in the counterbored area 428 as shown in FIG. 19. The countersunk holes 424 are configured to receive the fasteners 420 such that heads of the fasteners 424 align smoothly with an exterior surface 460 of the cam race 408 once the fasteners 424 are tightened into the threaded holes 416 of the upper receiver 400. Further, the thicknesses of the front and rear edges 440, 444 and the depths of the front and rear ends 432, 436 may be configured such that the exterior surface 460 of the cam race 408 aligns smoothly with the exterior surface of the sidewall 156 of the upper receiver 400.

While the cam race and methods have been described in terms of particular variations and illustrative figures, those of ordinary skill in the art will recognize that the cam race is not limited to the variations or figures described. In addition, where methods and steps described above indicate certain events occurring in certain order, those of ordinary skill in the art will recognize that the ordering of certain steps may be modified and that such modifications are in accordance with the variations of the cam race. Additionally, certain of the steps may be performed concurrently in a parallel process when possible, as well as performed sequentially as described above. To the extent there are variations of the cam race, which are within the spirit of the disclosure or equivalent to the cam race found in the claims, it is the intent that this patent will cover those variations as well. Therefore, the present disclosure is to be understood as not limited by the specific embodiments described herein, but only by scope of the appended claims.

What is claimed is:

1. An assembly for improving the longevity of a direct gas operated firearm, the assembly comprising:

a cam race configured to be secured into a recess disposed in an upper receiver wherein the cam race comprises an elongated backplate having a raised portion wherein the backplate is configured to be fastened into a counterbored portion disposed in a sidewall of the upper receiver such that the raised portion extends through an opening in the sidewall and further wherein the counterbored portion is disposed on an exterior of the sidewall, such that the backplate is fastened onto an exterior of the upper receiver;

a slide face of the cam race for supporting a cam pin in sliding contact;

threaded holes positioned along a length of the cam race; and fasteners for engaging the threaded holes to secure the cam to the upper receiver.

2. The assembly of claim 1, wherein the counterbored portion is disposed on an interior of the sidewall, such that the backplate is fastened onto the interior of the upper receiver.

3. An assembly for improving the longevity of a direct gas operated firearm, the assembly comprising:

a cam race configured to be secured into a window disposed in an upper receiver wherein the window extends through a sidewall of the upper receiver;

a slide face of the cam race for supporting a cam pin in sliding contact;

a corner surface for providing a hardened edge of a cam pocket of the upper receiver;

threaded holes positioned near the window; and fasteners for engaging with the threaded holes to secure the cam race in the upper receiver.

4. The assembly of claim 3, wherein the window is configured to receive the cam race in the form of an insert that positions the slide face and the corner surface inside the upper receiver to be contacted by the cam pin.

5. The assembly of claim 3, wherein the window is surrounded by a counterbored area that has a front end and a rear end that are configured to respectively receive a front edge and a rear edge of the cam race.

6. The assembly of claim 5, wherein the front edge and the rear edge are configured to engage respectively with the front end and the rear end of the counterbored area.

7. The assembly of claim 5, wherein the front edge and the rear edge have thicknesses that respectively cooperate with depths of the front end and the rear end of the counterbored area such that the corner surface and the slide face are positioned to receive the cam pin during reciprocal movement of a bolt carrier group within the upper receiver.

8. The assembly of claim 5, wherein the threaded holes are positioned in the counterbored area and are aligned with countersunk holes of the cam race.

9. The assembly of claim 8, wherein the cam race is retained in the counterbored area by fasteners being inserted through the countersunk holes and tightened into the threaded holes.

* * * * *